US005415461A

United States Patent [19]

Sakamoto

[11] Patent Number: 5,415,461

[45] Date of Patent: May 16, 1995

[54] FURNITURE CONSTRUCTION

[76] Inventor: Alice Sakamoto, 13315 Simon La., Los Altos Hills, Calif. 94022

[21] Appl. No.: 144,720

[22] Filed: Oct. 29, 1993

[51] Int. Cl.[6] ..... A47C 4/02

[52] U.S. Cl. ..... 297/440.1; 297/411.26; 297/440.21

[58] Field of Search ..... 297/440.1, 440.21, 440.22, 297/452.18, 452.19, 452.21, 452.22, 452.24, 452.55, DIG. 2, 440.13, 411.26–411.28

[56] References Cited

U.S. PATENT DOCUMENTS

| | | | |
|---|---|---|---|
| 2,818,107 | 12/1957 | Thaden . | |
| 3,521,929 | 7/1970 | Pearson | 297/452.55 X |
| 3,574,400 | 4/1971 | Day | 297/452.14 |
| 3,647,260 | 3/1972 | Grant et al. | 297/452.14 X |
| 3,841,704 | 10/1974 | Platner et al. | 297/452.14 X |
| 3,887,234 | 6/1975 | Curtis et al. | 297/440 |
| 3,931,384 | 1/1976 | Forquer et al. | 264/120 |
| 4,003,600 | 1/1977 | Horn | 297/454 |
| 4,123,105 | 10/1978 | Frey | 297/451 |
| 4,285,544 | 8/1981 | Zapf | 297/440.21 |
| 4,632,459 | 12/1986 | Herschlag | 297/440.1 |
| 4,647,109 | 3/1987 | Christophersen et al. | 297/457 |
| 4,733,910 | 3/1988 | Brennan | 297/300 |

OTHER PUBLICATIONS

"My First Furniture Set", *Troll Learn and Play*, Fall/-Winter 1993.

*Primary Examiner*—Peter R. Brown

*Attorney, Agent, or Firm*—James J. Leary; Carol A. Duffield

[57] ABSTRACT

Upholstered furniture, such as an armchair or couch, that is built on a thermoformed plastic frame that replaces the wooden frame in standard furniture construction. The thermoformed frame has a horizontal base with integrally molded legs which support the chair or couch and a vertical back and sides. A plastic foam insert is generally U-shaped so that it forms the undercushion of the seat, the sides of the chair and the arms of the chair in a single piece which fits into the thermoformed frame. The plastic foam insert is made so that it interlocks with the thermoformed frame without the need for additional fasteners. A fabric slipcover, which has zipper closures for easy installation and removal, covers the frame and the plastic foam insert and holds them together as a unit. A plastic foam seat cushion and a plastic foam back cushion, each with their own fabric covers, complete the chair or couch. The finished piece of furniture has the outward appearance of a standard upholstered chair or couch, which can be made in many different styles and decorated to match virtually any room decor. However, the furniture can be disassembled in moments without special tools for cleaning or repairs and reassembled just as quickly. The furniture construction is suitable for large or small volume manufacturing methods. In one preferred embodiment, the structure takes the form of a small armchair or couch for domestic pets, such as dogs or cats, which appears as a smaller version of an upholstered armchair or couch. The furniture can be made in different sizes for large or small pets, as well as for children and adults.

19 Claims, 4 Drawing Sheets

FURNITURE CONSTRUCTION

FIELD OF INVENTION

The present invention relates to a furniture construction for making upholstered furniture using a unitary thermoformed plastic frame. The furniture construction is applicable for making lightweight and sturdy full sized furniture or for making miniaturized furniture, such as special furniture for pets or children which simulates full size upholstered furniture such as armchairs or couches.

BACKGROUND OF THE INVENTION

A primary objective of the present invention is to provide a furniture construction for making low cost furniture which has the appearance of high quality upholstered furniture. Traditionally, high quality upholstered furniture is made by an expensive and laborious process of constructing a wooden frame, then building up the furniture with layers of webbing and/or springs, padding, cushions and finally covering it with fabric. While this traditional construction method results in furniture which is sturdy, durable and attractive, it is much too expensive for constructing low cost furniture for use by pets or children. The low cost construction techniques that are typically used for constructing furniture for pets or children does not result in furniture which is sturdy or durable or attractive enough to blend in with the decor of a well furnished room. For people who wish to include a pet bed for their dog or cat or small furniture for their children in their living room without detracting from the decorating scheme, there are no available options.

Maintenance is also an important issue. One of the major reasons for providing separate pet or child furniture is to save wear and tear on the more expensive regular household furniture. Pets and children can be very hard on furniture. They treat it roughly, they track in dirt, they sometimes inadvertently soil it and, at least with pets, they shed fur onto it. Traditional upholstered furniture is difficult to clean; often it requires special cleaning chemicals or professional cleaning equipment. Damage to upholstered furniture, such as when a pet has clawed or gnawed on the furniture, is also expensive to repair. Providing special furniture for the pets or children will help to reduce the wear and tear on the regular household furniture. It also helps to satisfy a child's sense of ownership or a pet's territorial instincts to provide them with furniture of their own to sit or lie on. It is important that special furniture for pets and children be easily and inexpensively cleaned and repaired. All this is in keeping with the desire to have the special furniture match with the rest of the regular furniture in a way that enhances, rather than detracts from, the room's decor. It is, therefore, desirable to provide a furniture construction which provides furniture which has all the desirable attributes of fine upholstered furniture by being sturdy, durable, attractive and which can be decorated to match other furnishings, but which at the same time is low cost and easily maintained.

SUMMARY OF THE INVENTION

In keeping with the foregoing discussion, a primary objective of the present invention is to provide a furniture construction for making lightweight and low cost furniture which has the appearance of high quality upholstered furniture and, therefore, blends in with the decor of a well furnished room. One aspect of this is to provide a furniture construction suitable for making full sized furniture which is lightweight in comparison to traditional upholstered furniture. Another aspect is to provide a furniture construction which is also suitable for making special furniture for pets or children which is sturdy, durable, attractive and easily maintained. The special pet or child furniture should have the appearance of full size adult furniture, such as an armchair or couch, with only the scale changed.

It is another objective of the invention to provide a furniture construction which will be able to withstand normal to heavy use without showing excessive wear or becoming deformed. It is a further objective of the invention that the finished furniture be easy to keep clean by normal household cleaning methods, without the need for chemical cleaning agents or professional cleaning equipment. It is a further objective of the invention to provide a furniture construction that allows simple and inexpensive repairs in case of permanent stains, holes being chewed in the fabric or padding or hard use wearing the fabric. For this reason, the furniture should be made easy to assemble and disassemble and be modular in construction to allow replacement of worn parts.

In keeping with these objectives, the present invention takes the form of a piece of upholstered furniture, such as an armchair or couch, that is built on a thermoformed plastic frame that replaces the wooden frame in standard furniture construction. The thermoformed plastic frame is very lightweight compared to a traditional wooden furniture frame. The thermoformed frame has a horizontal base with integrally molded legs which support the chair or couch and a vertical back and sides. A plastic foam insert is generally U-shaped so that it forms the undercushion of the seat, the sides of the chair and the arms of the chair in a single piece which fits into the thermoformed frame. The plastic foam insert is made so that it interlocks with the thermoformed frame without the need for additional fasteners. A fabric slipcover, which has zipper closures for easy installation and removal, covers the frame and the plastic foam insert and holds them together as a unit. A plastic foam seat cushion and a plastic foam back cushion, each with their own fabric covers, complete the chair or couch. The finished piece of furniture has the outward appearance of a standard upholstered chair or couch, which can be made in many different styles and decorated to match virtually any room decor. However, the furniture can be disassembled in moments without special tools for cleaning or repairs and reassembled just as quickly. The furniture construction is suitable for large or small volume manufacturing methods.

In one preferred embodiment, the invention takes the form of a small armchair or couch for domestic pets, such as dogs or cats, which appears as a smaller version of an upholstered armchair or couch. The invention can be made in different sizes for large or small pets. Other objects and advantages of the invention will no doubt occur to those skilled in the art upon reading and understanding the following detailed description along with the accompanying drawings.

DETAILED DESCRIPTION OF THE INVENTION

Figure 1:
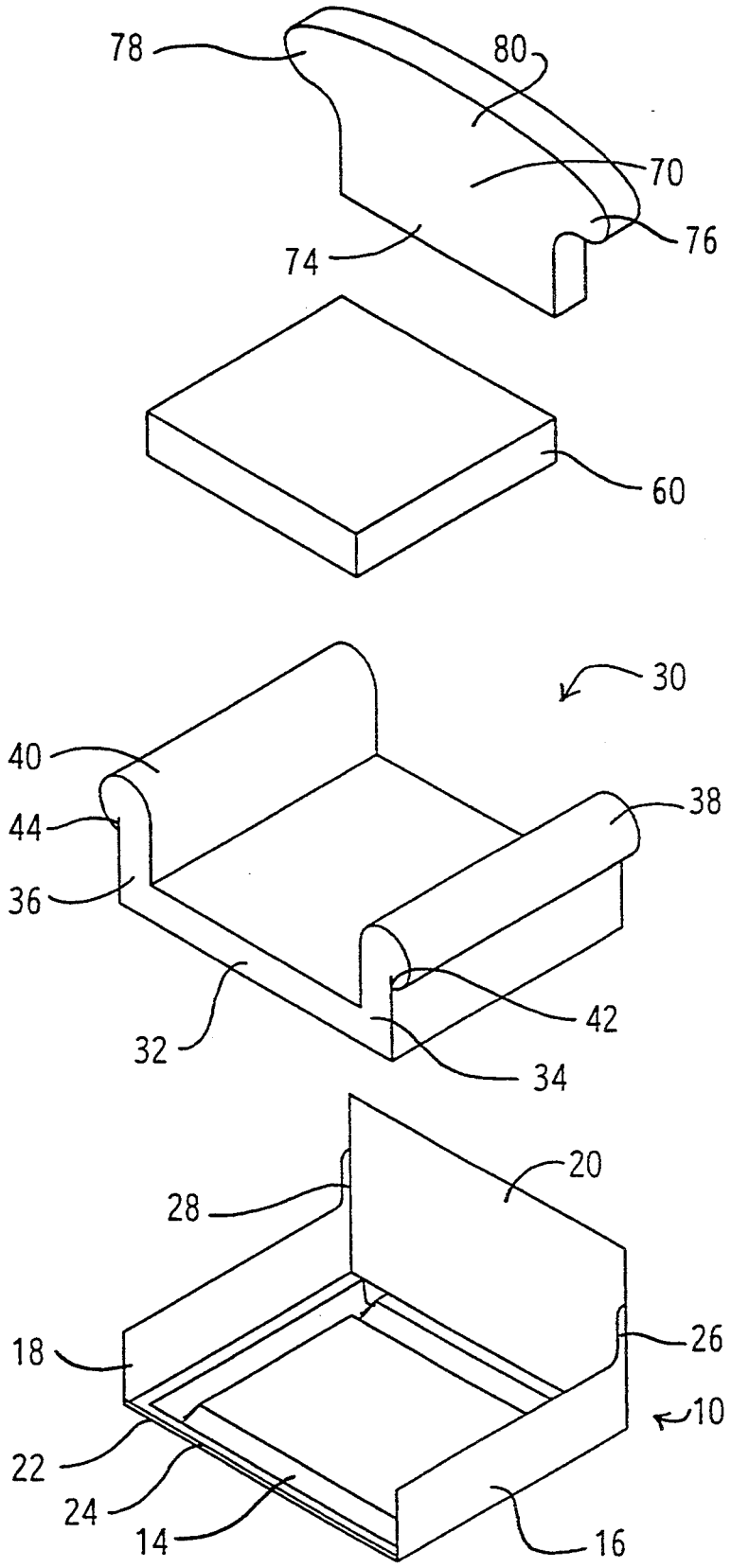
FIG. 1 shows an exploded view of the furniture construction.

FIG. 1 shows an exploded view of the furniture construction of the present invention. The illustrated construction is for an armchair built according to the present invention. It should be understood that the same construction can be used for couches and other similar pieces of furniture. The thermoformed frame 10 of the furniture is formed of a single sheet of thermoformable plastic, such as polycarbonate, polystyrene, or polyvinyl chloride, with a thickness of approximately 0.10–0.25 inch. The thermoformed frame 10 provides a rigid support structure for the furniture construction. The frame 10 has a horizontal base 12 with integrally molded legs 14, which support the base 12 up off of the floor. In the preferred embodiment, the legs 14, form a flat-bottomed, V-shaped ridge which runs around bottom of the base 12 just inside of the periphery of the frame 10. The geometry of the integrally molded legs 14 reinforces and rigidifies the base 12 of the frame 10. The front edge 22 of the base 12 has an upstanding lip 24 which reinforces the front edge 22 of the base 12 and helps to hold the plastic foam insert 30 in place, which will be discussed more later. The frame 10 also has a pair of vertical side panels 16, 18 on the right and the left sides of the frame 10. The side panels 16, 18 of the frame 10 are joined integrally with the back panel 20 of the frame 10, which is vertical or slightly inclined. At the junction between the side panels 16, 18 and the back panel 20 of the frame, there are a pair of tabs 26, 28 that extend upward from the side panels, the function of which will be explained below.

The plastic foam insert 30 is made of a flexible plastic foam, such as PVC foam, polyurethane foam, polyethylene foam or foam rubber. The plastic foam insert 30 can be molded as one integral piece for high volume production or it can be assembled from standard shapes of extruded foam for low volume production. The plastic foam insert 30 is in the general shape of a shallow U. The bottom of the U forms the undercushion 32 of the chair seat. The sides of the U form the cushions for the sides 34, 36 of the chair. At the top edge of the U there are two cylindrical bolsters 38, 40 which form the arms of the chair. A groove 42, 44 runs along the underside of each cylindrical bolster 38, 40 where they join the sides 34, 36 of the insert 30. When the plastic foam insert 30 is inserted into the thermoformed frame 20, the grooves 42, 44 interlock the top edges of the side panels 16, 18 of the frame 20. The grooves 42, 44 are cut deeper into the foam at the rear of the insert 30 so that the grooves 42, 44 can interlock with the tabs 26, 28 which extend upward from the side panels 16, 18.

Figure 4:
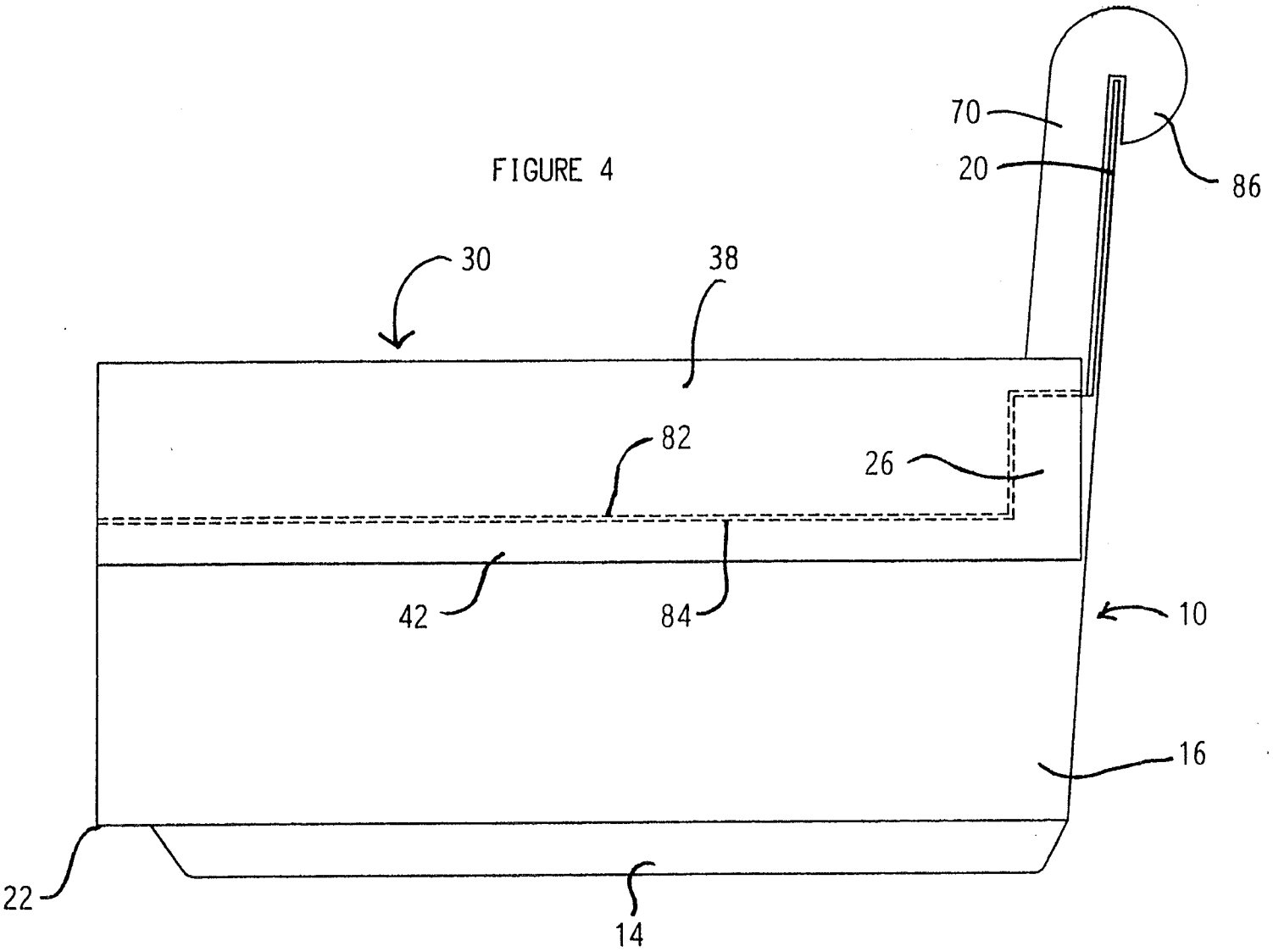
FIG. 4 shows a side view of a partially assembled piece of furniture.

FIG. 4 is a detail drawing showing how the plastic foam insert 30 interlocks with the thermoformed plastic frame 10. The furniture is shown in a partially assembled state. The arm bolster 38 of the plastic foam insert 30 rests on top of the side panel 16 of the frame 10. The tab 26 inserts into the groove 42 on the underside of the arm bolster 38 to hold it in place. Optionally, the groove 42 can extend along the entire lower edge of the arm bolster 38, engaging the entire upper edge 84 of the side panel 16. Hidden line 82 shows the bottom of the groove 42 where it meets with the upper edge 84 of the side panel 16.

Referring again to FIG. 1, the undercushion 32 rests on the base 12 of the frame 10 and is held in place by the upstanding lip 24 on the front edge 22 of the base 12. With the lip 24 holding the undercushion 32 in place and the cylindrical bolsters 38, 40 interlocked with the side panels 16, 18 and the tabs 26, 28 of the frame 20, the foam insert 30 is securely held within the frame 10. If additional attachment security is desired, removable fasteners, such as hook-and-loop fasteners, can be added to hold the foam insert 30 to the frame 10. Glue or other permanent fasteners should not be used because then the chair will not be easily disassembled and reassembled when necessary for cleaning or repairs.

Figure 2:
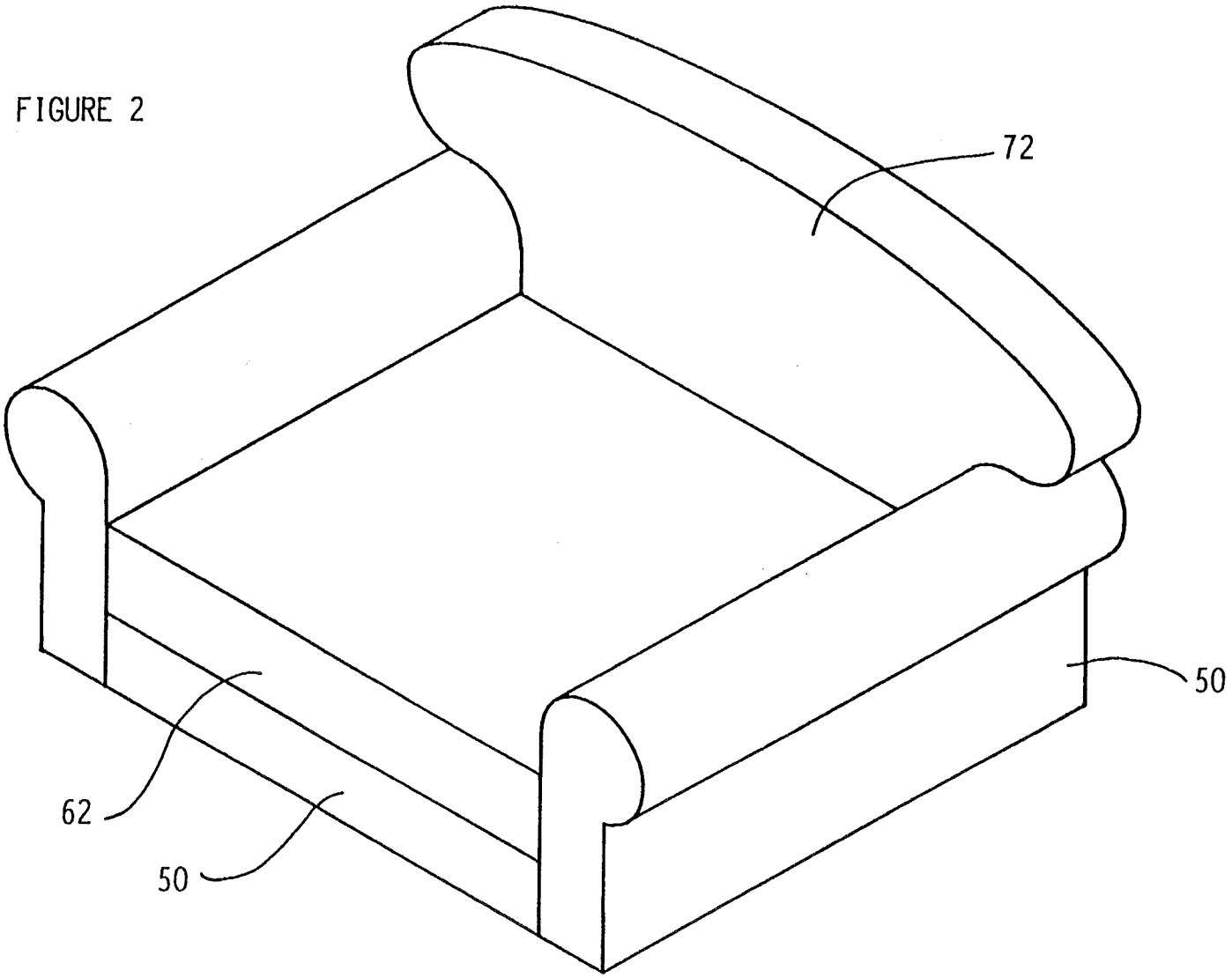
FIG. 2 shows a front perspective view of the assembled furniture.
Figure 3:
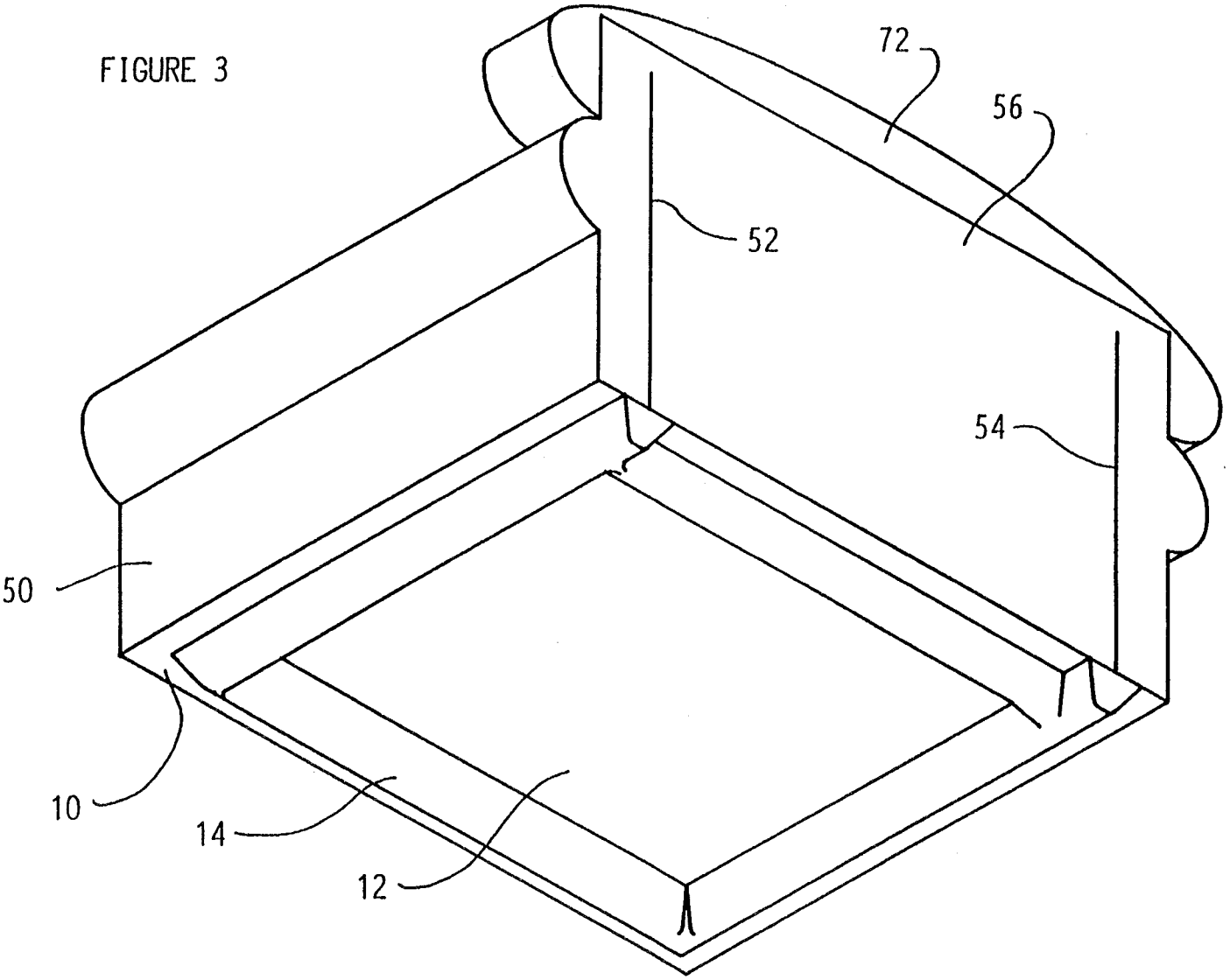
FIG. 3 shows a rear perspective view of the assembled furniture.

A form-fitting fabric slipcover 50, which can be seen from the front in FIG. 2 and from the rear in FIG. 3, fits snugly over the assembled thermoformed frame 10 and foam insert 30. The slipcover 50 not only adds visual appeal to the assembled chair, but it also serves to hold the assembled pieces securely together. Two zipper closures 52, 54 are provided on the back 56 of the slipcover 50 to allow easy installation. Alternatively, equivalent fasteners, such as hook-and-loop fasteners, can be used in place of the zippers 52, 54.

The next piece to be assembled is a plastic foam back cushion 70. The lower portion 74 of the back cushion 70 is cut to fit between the sides 34, 36 of the foam insert. The upper portion 80 of the back cushion 70 extends above the back 20 of the thermoformed frame 10 to cushion the rigid plastic. The upper portion 80 is curved and has a pair of wings 76, 78 which extend to the sides above the cylindrical bolsters 38, 40. The back cushion 70 is covered with a form-fitting fabric cover 72, which can be seen in FIGS. 2 and 3. A zipper closure, or the equivalent, runs along the lower edge of the fabric cover 72 so that it will be concealed when the back cushion 70 is in place. The final piece to be assembled is the plastic foam seat cushion 60 which is made from a rectangular slab of plastic foam with its own fabric cover 62. A zipper closure, or the equivalent, runs along the back edge of the fabric cover 62 so that it will be concealed when the seat cushion 60 is in place. The foam insert 30, the back cushion 70 and the seat cushion 60 can be made of the same flexible plastic foam material or, if desired, the foam insert 30 can be made of a slightly more rigid plastic foam to give the undercushion 32, and the sides 34, 36 and arms 38, 40 of the chair more structure. This modification would be desirable if the chair was meant for use by larger animals or children. Preferably, the seams of the fabric covers 50, 62, 72 are sewn with welt, also known as piping or cording, to visually enhance the chair and to make it look more like fine upholstered furniture. Other decorative features such as gimp, tufting or flounces can be added to enhance the visual appeal or to make the chair match with the rest of the room furniture. The design of the furniture can be modified to imitate many traditional and contemporary furniture styles to match the room decor.

One potential modification of the furniture construction contemplated by the inventor involves molding the plastic foam back cushion 70 and/or the plastic foam seat cushion 60 integrally with the plastic foam insert 30. The back cushion 70 would be slotted 86, as shown in FIG. 4, so that it interlocks with the back panel 20 of the frame 10 as described for the arms 38, 40 of the foam insert 30 above. Such an integrally molded unitary foam insert would lower the manufacturing and assembly costs of the furniture for high volume production.

As mentioned above, although furniture constructed according to the invention has the appearance of fine upholstered furniture, unlike standard upholstered furniture it can be quickly and easily disassembled for cleaning or repairs. The parts interlock in a way that holds the furniture together without the need for permanent fasteners that would inhibit assembly and disassembly. The materials are all chosen for easy washing. The fabric covering can be easily removed and washed in a home washing machine to remove dirt or fur. If a more complete cleaning is needed because of lapses in house breaking or toilet training, the furniture can be stripped right down to the frame in seconds so that the frame and cushions can be rinsed out under the hose. After the cushions have been squeezed out and dried, the furniture can be reassembled just as quickly. Because of the modular construction of the furniture, a single part can be replaced to repair the furniture after damage from an overly rambunctious child or pet.

Although the examples given include many specificities, they are intended as illustrative of only some of the possible embodiments of the invention. Other embodiments and modifications will, no doubt, occur to those skilled in the art. While the furniture has been described as primarily of use for pets, the inventor also contemplates that children, may find the present invention more comfortable since the size of the furniture is more in keeping with the size of the child. The furniture can also be made in larger sizes suitable for adults. Thus, the examples given should only be interpreted as illustrations of some of the preferred embodiments of the invention, and the full scope of the invention should be determined by the appended claims and their legal equivalents.

I claim:

1. A furniture construction comprising:

a unitary plastic frame, said frame having a horizontal base, a substantially vertical back panel joined to said base, a substantially vertical left side panel joined to said base and joined to said back panel, and a substantially vertical right side panel joined to said base and joined to said back panel, a removable plastic foam insert formed from a resilient plastic foam material, said insert having a horizontal bottom portion which rests on said horizontal base, a left wall portion extending upward from said bottom portion adjacent to said left side panel, a left side arm bolster attached to said left wall portion, a right wall portion extending upward from said bottom portion adjacent to said right side panel, a right side arm bolster attached to said right wall portion, at least one tab attached to said frame proximate the juncture between said left side panel and said back panel, and at least one tab attached to said frame proximate the juncture between said right side panel and said back panel, said left side arm bolster having a slot which engages the tab proximate the juncture between said left side panel and said back panel, said right side arm bolster having a slot which engages the tab proximate the juncture between said right side panel and said back panel, and a fabric slipcover which covers said frame and said insert.

2. The furniture construction of claim 1 wherein said unitary plastic frame is thermoformed from a single sheet of thermoformable plastic.

3. The furniture construction of claim 1 wherein said unitary plastic frame further comprises at least one depending foot molded integrally with said horizontal base.

4. The furniture construction of claim 1 wherein said horizontal base has a front edge, said front edge having an upstanding lip, said bottom portion of said insert being held in position by said upstanding lip.

5. A furniture construction comprising:

a unitary plastic frame, said frame being thermoformed from a single sheet of thermoformable plastic, said frame having a horizontal base, at least one depending foot molded integrally with said horizontal base, a substantially vertical back panel joined to said base, a substantially vertical left side panel joined to said base and joined to said back panel, and a substantially vertical right side panel joined to said base and joined to said back panel, at least one vertically disposed tab attached to said frame proximate the juncture between said left side panel and said back panel, and at least one vertically disposed tab attached to said frame proximate the juncture between said right side panel and said back panel, said horizontal base having a front edge, said front edge having an upstanding lip, a removable plastic foam insert formed from a resilient plastic foam material, said insert having a horizontal bottom portion which rests on said horizontal base and is held in position by said upstanding lip, a left wall portion extending upward from said bottom portion adjacent to said left side panel, a left side arm bolster attached to said left wall portion, said left side arm bolster having a vertically disposed slot which engages the vertically disposed tab proximate the juncture between said left side panel and said back panel, a right wall portion extending upward from said bottom portion adjacent to said right side panel, a right side arm bolster attached to said right wall portion, said right side arm bolster having a vertically disposed slot which engages the vertically disposed tab proximate the juncture between said right side panel and said back panel, and a form-fitting fabric slipcover which covers said frame and said insert.

6. The furniture construction of claim 5 wherein said left side panel of said frame has a horizontal upper edge, and said right side panel of said frame has a horizontal upper edge, and wherein said left side arm bolster of said removable plastic foam insert has a vertically disposed slot which engages the horizontal upper edge of said left side panel, and said right side arm bolster of said removable plastic foam insert has a vertically disposed slot which engages the horizontal upper edge of said right side panel.

7. The furniture construction of claim 5 wherein said removable plastic foam insert further comprises a back wall portion extending upward from said bottom portion adjacent to said back panel of said frame.

8. The furniture construction of claim 7 wherein said back panel of said frame has a horizontal upper edge, and wherein said back wall portion of said removable plastic foam insert has a vertically disposed slot which engages the horizontal upper edge of said back panel.

9. The furniture construction of claim 5 further comprising: a plastic foam seat cushion having a fabric seat cover, said plastic foam seat cushion resting on said bottom portion of said removable plastic foam insert, and a plastic foam back cushion having a fabric back cushion cover, said plastic foam back cushion resting against said back panel of said frame.

10. The furniture construction of claim 9 wherein said removable plastic foam insert is formed from a first resilient plastic foam material and said plastic foam seat cushion and said plastic foam back cushion are formed from a second resilient plastic foam material, said second resilient plastic foam material being relatively more flexible than said first resilient plastic foam material.

11. A pet bed construction for constructing a pet bed in the form of a miniature chair or couch for use by a domestic pet, said pet bed construction comprising:

a unitary plastic frame, said frame having a horizontal base, a substantially vertical back panel joined to said base, a substantially vertical left side panel joined to said base and joined to said back panel, and a substantially vertical right side panel joined to said base and joined to said back panel, a removable plastic foam insert formed from a resilient plastic foam material, said insert having a horizontal bottom portion which rests on said horizontal base, a left wall portion extending upward from said bottom portion adjacent to said left side panel, a left side arm bolster attached to said left wall portion, a right wall portion extending upward from said bottom portion adjacent to said right side panel, a right side arm bolster attached to said right wall portion, at least one tab attached to said frame proximate the juncture between said left side panel and said back panel, and at least one tab attached to said frame proximate the juncture between said right side panel and said back panel, said left side arm bolster having a slot which engages the tab proximate the juncture between said left side panel and said back panel, said right side arm bolster having a slot which engages the tab proximate the juncture between said right side panel and said back panel, and a fabric slipcover which covers said frame and said insert.

12. The pet bed construction of claim 11 wherein said unitary plastic frame is thermoformed from a single sheet of thermoformable plastic.

13. The pet bed construction of claim 11 wherein said unitary plastic frame further comprises at least one depending foot molded integrally with said horizontal base.

14. The pet bed construction of claim 11 wherein said horizontal base has a front edge, said front edge having an upstanding lip, said bottom portion of said insert being held in position by said upstanding lip.

15. The pet bed construction of claim 11 wherein said removable plastic foam insert further comprises a back wall portion extending upward from said bottom portion adjacent to said back panel of said frame.

16. The pet bed construction of claim 15 wherein said back panel of said frame has a horizontal upper edge, and wherein said back wall portion of said removable plastic foam insert has a vertically disposed slot which engages the horizontal upper edge of said back panel.

17. The pet bed construction of claim 11 further comprising:

a plastic foam seat cushion having a fabric seat cover, said plastic foam seat cushion resting on said bottom portion of said removable plastic foam insert, and a plastic foam back cushion having a fabric back cushion cover, said plastic foam back cushion resting against said back panel of said frame.

18. The pet bed construction of claim 11 wherein said removable plastic foam insert is formed from a first resilient plastic foam material and said plastic foam seat cushion and said plastic foam back cushion are formed from a second resilient plastic foam material, said second resilient plastic foam material being relatively more flexible than said first resilient plastic foam material.

19. The pet bed construction of claim 11 wherein said horizontal bottom portion of said removable plastic foam insert is of sufficient size to support a domestic dog or cat.

* * * * *